United States Patent [19]

Ferlise

[11] Patent Number: 4,930,168

[45] Date of Patent: Jun. 5, 1990

[54] SWIMMING POOL WITH CONVERTIBLE HOT TUB

[76] Inventor: Victor J. Ferlise, 254 S. Shore Dr., Toms River, N.J. 08753

[21] Appl. No.: 358,125

[22] Filed: May 30, 1989

[51] Int. Cl.[5] ..... E04H 3/18

[52] U.S. Cl. ..... 4/489; 4/493; 4/505

[58] Field of Search ..... 4/488, 489, 505, 493, 4/661; 128/66

[56] References Cited

U.S. PATENT DOCUMENTS

| | | | |
|---|---|---|---|
| 3,460,166 | 8/1969 | Weber | 4/493 |
| 3,623,165 | 11/1971 | Whittell, Jr. | 4/489 |
| 3,691,773 | 9/1972 | Ruhlman | 4/489 X |
| 3,781,925 | 1/1974 | Curtis et al. | 4/493 |
| 3,837,016 | 9/1974 | Schindler et al. | 4/489 |
| 3,952,338 | 4/1976 | Troxclair | 4/489 X |
| 4,001,899 | 1/1977 | Mathis | 4/489 |
| 4,100,746 | 7/1978 | Preus | 4/489 X |
| 4,126,905 | 11/1978 | Russell et al. | 4/489 X |
| 4,149,281 | 4/1979 | Bob et al. | 4/489 |
| 4,185,333 | 1/1980 | Ortega | 4/489 |
| 4,240,165 | 12/1980 | Kyrias | 4/505 X |

*Primary Examiner*—Henry K. Artis
*Attorney, Agent, or Firm*—Jeremiah G. Murray

[57] ABSTRACT

A swimming pool with a convertible hot tub that may be easily installed or removed by a user. A barrier system, having a removable partition formed from a flexible sheet of material, is placed in the pool tank near an area that includes a hot water inlet nozzle. The partition has fasteners formed as peripheral ribs that slide into slotted channels secured to opposite sides of the tank. A water drain is located in the pool area. A water processing system, having a pump and a water heater, is connected between the drain and the inlet nozzle to remove warm water from the pool area, heat the water and supply hot water to the inlet nozzle to increase the temperature of the water in the hot tub. At equilibrium, the partition permits water to flow from the hot tub into the pool area at a rate substantially equal to the rate at which water is supplied to the hot tub via the inlet nozzle. The partition along with the continuous flow of water from the hot tub directly into the pool prevents the chilled water in the pool area from returning to the hot tub.

20 Claims, 2 Drawing Sheets

SWIMMING POOL WITH CONVERTIBLE HOT TUB

BACKGROUND OF THE INVENTION

The present invention relates to swimming pools and, more particularly, to heated swimming pools having means for selectively converting a portion thereof into a hot tub.

Those concerned with the development of swimming pools have long recognized the advantages, particularly in terms of cost and convenience, of locating a hot tub in the general vicinity of a swimming pool. In many cases, the hot tub and swimming pool are contiguous, having a rigid, common wall over which water may easily spill from the hot tub into the pool. It is often the case that the common wall is also designed to permit the user to freely pass over the wall when moving between the pool and hot tub. In a typical layout, the hot tub and the pool share many of the system facilities, such as the pump, the filter, the heater, etc.

In the past, attempts have been made to reduce construction and maintenance costs of heated swimming pool systems by providing a system wherein more of the system components are commonly shared. The sharing of system components to reduce costs is an especially critical problem when it is necessary to install a new hot tub near to or as part of an existing swimming pool facility.

Prior art proposals directed at solving this problem may be found in U.S. Pat. Nos. 4,126,905 and 4,149,281. These patents shown systems wherein a hot tub is designed to float in an existing heated swimming pool. Although these prior art systems may have served the purpose, they are not entirely satisfactory for the reasons that considerable cost will be necessary for their manufacture, use and repair. For example, such floating hot tubs are usually constructed of a relatively large number of parts, making them difficult to assemble and susceptible to frequent damage. Additionally, these prior art systems are generally heavy and bulky, making them cumbersome for a single user to install, remove and use. In short, these systems are unduly complicated, expensive to manufacture, and difficult to employ.

For these and other reasons evident to those skilled in these arts, there has been a need for improved swimming pool-hot tub structures that effectively solves such problems as cost, weight, complexity, portability, and the like. The present invention fulfills this need.

SUMMARY OF THE INVENTION

The general purpose of this invention is to provide a swimming pool system with a convertible hot tub arrangement that embraces all the advantages of similarly employed prior art devices and possesses none of the aforementioned disadvantages. To attain this, the present invention contemplates a unique swimming pool system having a portable barrier that may be selectively mounted in the pool by the user so as to partition a predetermined section of the pool into a hot tub area while maintaining the remaining portion as a pool area. It is also contemplated that the tub area include the usual hot water supply for the system and that the drain be located in the pool area. It is further contemplated that the barrier by mounted in the pool such that the hot water in the hot tub area will continuously circulate at a controlled rate directly into the pool area. As such, a flow system is created so that there is a continuous removal of hot water from the tub area via the pool area at an average rate equal to the rate that hot water is supplied to the tub area. Consequently, this flow system will result in cleaner tub water and in retarding the growth of unwanted matter, such as bacteria, algae and the like, in the tub area.

It is, therefore, an object of the present invention to provide a convertible hot tub system that is inexpensive to manufacture, install and maintain.

Another object is to provide a portable hot tub structure that is light in weight and can be readily used be a private pool owner as an accessory to an existing conventional heated pool.

A further object of the invention is the provision of a convertible hot tub system that can be installed and removed easily and rapidly by a single user.

Still another object is to provide a convertible hot tub in a heated swimming pool in which the hot water supply for the pool is used directly by the hot tub when desired.

A still further object of the invention is to provide a hot tub that requires little or no additional maintenance and that has its water cleaned, removed and replaced simply and quickly.

Yet another object of the invention is to provide a convertible hot tub, as part of a heated swimming pool, that requires no additional energy above that required to heat the swimming pool.

With these and other objects in view, as will hereinafter more fully appear, and which will be more particularly pointed out in the appended claims, reference is now made to the following description of preferred embodiments taken in connection with the accompanying drawings in which:

DETAILED DESCRIPTION OF THE PREFERRED EMBODIMENTS

Figure 1:
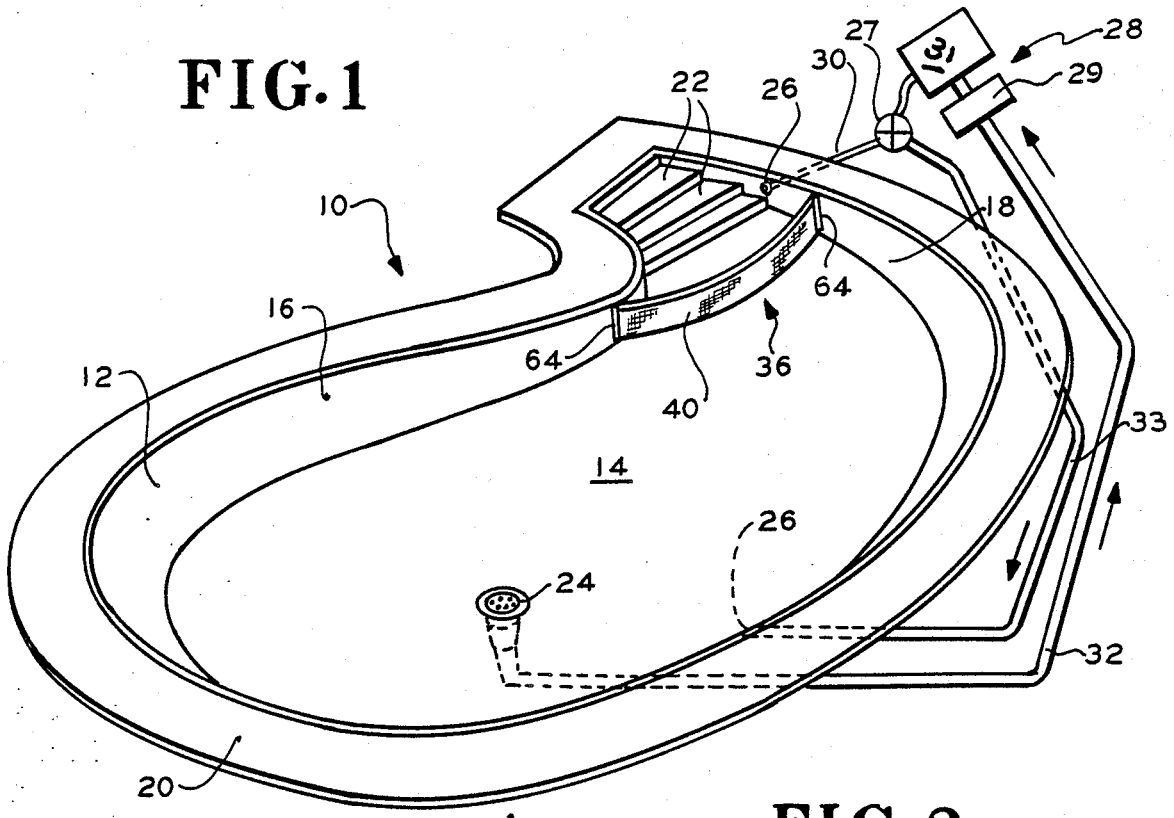
FIG. 1 shows a pictorial illustration of a preferred embodiment.

Referring now to the drawings, there is shown in FIG. 1 a swimming pool system 10 composed of a tank 12 having a bottom wall 14 and side walls 16, 18 defining an open top. An apron 20 surrounds the open top and abuts the upper edge of the side walls 16, 18. A plurality of steps 22, located at one end of the tank 12, extend from the apron 20 to the floor 14. The tank 12 is shown in FIG. 1 to have a shallow end, near steps 22, and a deep end in which a water drain 24 is located. Water inlet nozzles 26 are located in the side wall 18 at the shallow end adjacent the steps 22 and in the deep end. The portion of the swimming pool system 10 so far described is generally of standard configuration well known to those skilled in these arts. The particular shape and configuration of tank 12 as shown here is merely illustrative and not meant to be limiting.

The system 10 also includes a means for processing the water to be used in the tank 12. It is contemplated in the present invention that water be removed from the tank 12 at the deep end of the pool, that the removed water then be heated to an elevated temperature and that the heated water then be returned to the tank at the location of the hot tub. To effect this processing, a typical water processing system 28 would include a pump 29 connected to the drain 24, via drain line 32, and a heater 31 connected to the inlet nozzles 26, via valve 27 and water supply lines 30, 33. Pump 29 is connected directly to heater 31. The normal directions of water flow in lines 30, 32, 33 are indicated by arrows in FIG. 1. The processing system 28 may be readily implemented with commercially available pumps and water heaters. Of course, it is understood that the water processing system 28 may also include filters, chlorinators, additional valves, etc. in addition to the pump 29, valve 27 and heater 31. Also illustrated in FIG. 1 is a water barrier system 36 which is mounted between side walls 16, 18 in the shallow end of tank 12 just in front of steps 22.

Now with particular reference to FIGS. 1–6, the barrier system 36 is seen to consist of a partition 40 and a fastening means for mounting partition 40 in a vertical position, thereby dividing the tank 12 into a pool area, to include drain 24, and a hot tub area, to include at least one inlet nozzle 26. Partition 40 preferably includes a flexible sheet 42 having a top hem 58, and double-stitched side hems 44, 46 that form tubes in which ropes 48, 50 are located to form enlarged fastening ribs 52, 54. The ribs 52, 54 extend along the sides of sheet 42 and terminate short of a bottom hem 56, forming a short skirt 60 at the bottom of sheet 42.

Figure 3:
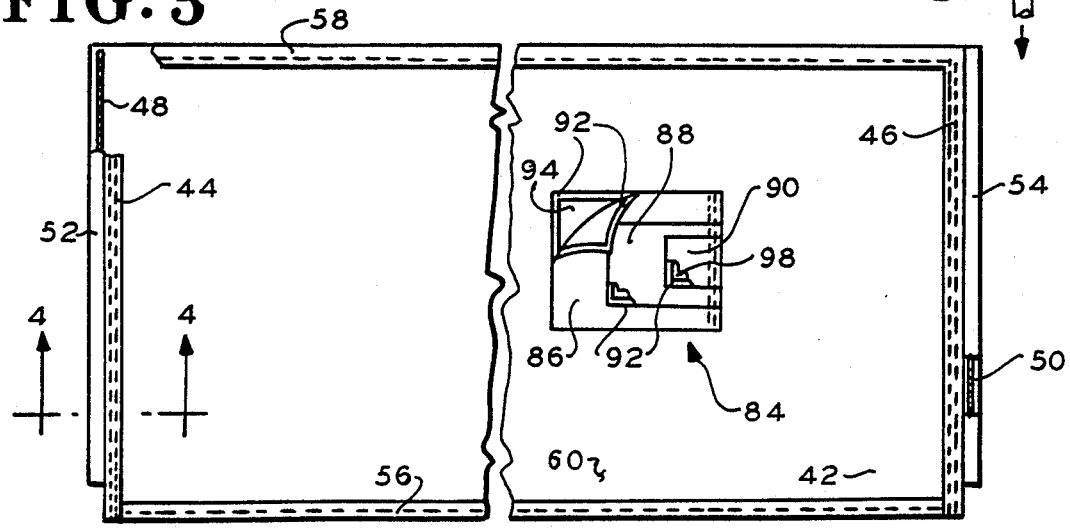
FIG. 3 is a front elevation, partly in section, of a portion of the apparatus shown in FIG. 1.
Figure 4:
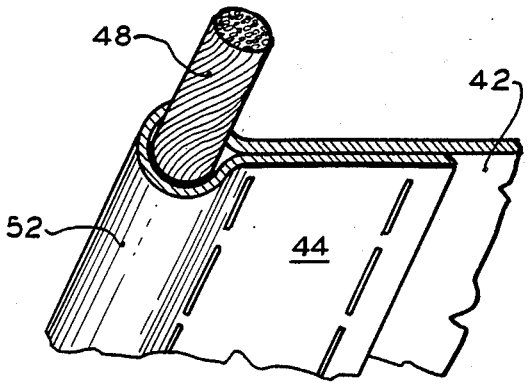
FIG. 4 is a pictorial section of the device shown in FIG. 3 taken substantially on the line 4—4 of FIG. 3 and looking in the direction of the arrows.

The general configuration of partition 40 is shown in FIG. 3 to be rectangular for convenience of illustration only. It is contemplated that sheet 42 will have, in general, the upper hem 58 straight and the depending side hems 44, 46 shaped to conform to the general shape of side walls 16, 18 such that the partition 40 will approximate the cross sectional shape of the tank 12. The bottom hem 56 is to be shaped to conform generally to the shape of the bottom wall 14 such that skirt 60 will generally follow the contour thereof. The height of partition 40, when mounted in tank 12, is to be greater than the normal water depth.

The sheet 42 may be fabricated from any of the many commericially available materials that will resist being adversely effected under prolonged use in water. For this purpose, the many different synthetic materials used to fabricate sails would be ideal. In addition to being highly resistant to decay or deterioration, such sail materials also hold their shape when wet, a highly desirable feature for the present invention. Nylon would be an ideal choice.

Figure 5:
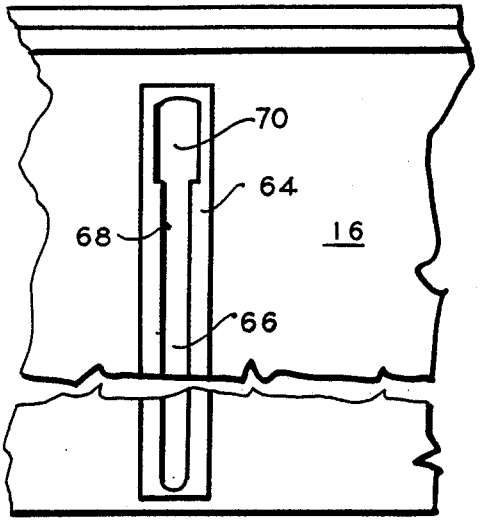
FIG. 5 is a side elevation of a detail of a portion of the structure shown in FIG. 1.
Figure 6:
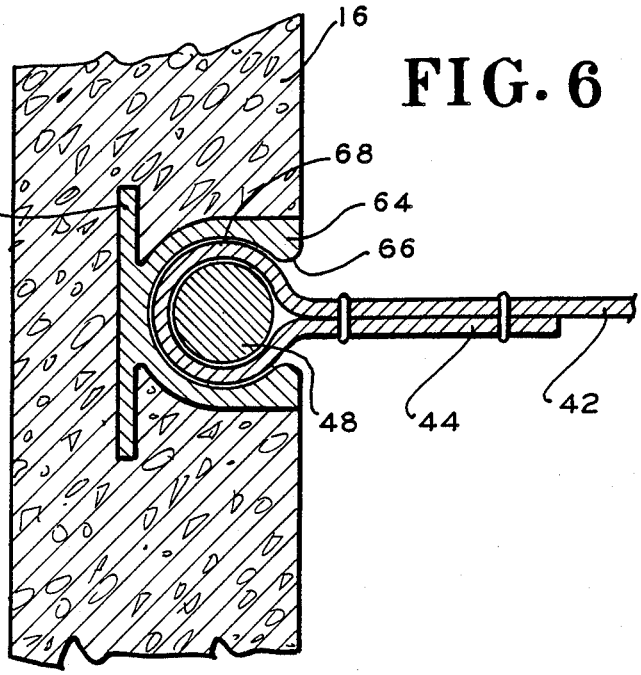
FIG. 6 is a section taken on the line 6—6 of FIG. 2 and looking in the direction of the arrows.

Partition 40 is removably fastened in place by brackets 64 secured to side walls 16, 18. As seen in FIGS. 5, 6, the bracket 64 is designed to be used with concrete walls and to be installed during the initial wall construction. Bracket 64, embedded in the concrete wall 16 (FIG. 6), has a narrow elongated slot 66 and a wider channel 68 for slidably receiving the ribs 52, 54 of partition 40. At the upper end of bracket 64, the slot 66 is contiguous with a wider opening 70 through which the ribs 52, 54 are threaded when installing and removing partition 40. The bracket 64 also includes a retaining flange 72 to cooperate with the concrete for securing the bracket 64 therein. Those skilled in these arts will appreciate that similarly shaped fastening brackets may be readily designed for use with tanks made of other materials, e.g. vinyl, fiberglass, etc. For example, slotted channels similar to bracket 64 may be molded as an integral part of the side walls of a molded fiberglass tank.

Figure 7:
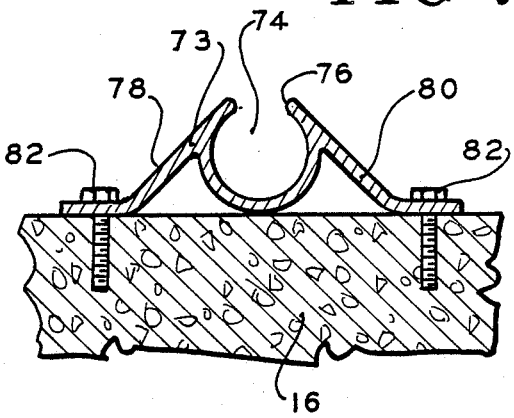
FIG. 7 is a view similar to that of FIG. 6 showing an alternate embodiment.

FIG. 7 depicts the cross sectional shape of a fastening bracket 73, having a rib-receiving channel 74, a slot 76 and mounting flanges 78, 80, which may be secured by bolts 82 to the surface of an existing tank wall 16. Bracket 72 will have, generally, a configuration similar to that of bracket 64 as seen in FIG. 5. For retrofitting a previously fabricated vinyl or fiberglass pool with fastening brackets similar to bracket 72, it will be necessary to insure that sealing structures be provided to prevent leakage through the walls thereof.

Finally, the partition 40 is provided with a hatch system 84 for regulating the flow of water past the partition 40. Hatch system 84 includes a plurality of commonly hinged rectangular flaps 86, 88, 90, each having Velcro-type fasteners 92 secured along three sides thereof. The flaps 86, 88, 90 are sewn along one common side to sheet 42 so as to selectively cover an opening 94 in sheet 42. The opening 94 is framed on three sides by a Velcro-type fastener 92 for permitting the flap 86 to be secured thereto. Flaps 86, 88 each have similar openings 96, 98, respectively, also framed by Velcro-type fasteners for permitting the selective securing of flaps 88, 90, respectively, thereto. The hatch system 84 is preferably located near the upper portion of sheet 42.

The operation of the hot tub is as follows: The user first fastens the partition 40 to walls 16, 18 by securing ribs 52, 54 in brackets 64 in the manner shown in FIG. 1. During this step, the pump 29 is preferably turned off to prevent pressures from currents or water build up in the tub area to make it difficult to slide the ribs 52, 54 in the channels 68, 74. After the partition 40 is properly arranged with the top hem 58 extending slightly above the upper surface of the water, and with the skirt 60 lying on the surface of the bottom wall 14, the pump 29 in the water processing system 28 is turned on and the valve 27 is positioned such that heated water is supplied to the tank 12 via the inlet nozzle 26 located in the hot tub only. This action will result in a build up of a very small head of water in the hot tub area as depicted by numeral 75 in FIG. 2. In most situations, this head 75 is not perceptible to the user. As such, there will be a slight difference in water pressure in the tank 12 on opposite sides of the partition 40, thereby causing the flexible sheet 42 to billow out and form a relatively rigid wall and thus no further supporting structure is required. This difference in water pressure will also cause a stream of water in the hot tub area to continuously circulate under skirt 60 along the surface of bottom wall 14 and into the pool area as depicted by the arrows in FIG. 2. At equilibrium, the flow rate of the water passing partition 40 will be substantially equal to the flow rate of the water being supplied through nozzle 26.

Because of the pressure difference between the pool and tub areas, water from the pool area is prevented from chilling the hot tub water by recirculating back past partition 40 into the hot tub area. Therefore, any difference in temperature between the heated supply water at nozzle 26 in the hot tub and the coolest water in the hot tub, usually the water adjacent the bottom wall 14, will primarily be a function of the size of the hot tub as well as the amount of heat loss through the open top, the walls 14, 16, 18, and the sheet 42. Of course, most of the heat loss will be used to heat the swimming pool area.

To attain the equilibrium condition, wherein the flow rates from nozzle 26 and past partition 40 are substantially equal, the flow rate from nozzle 26 may be varied at the water processing system 28, an operation that will usually not be necessary since any pressure buildup in the hot tub will be immediately compensated for be an increase in flow past the partition 40. The location of the water flow past partition 40 may also be adjusted by opening one or more of the flaps 86, 88, 90 in hatch system 84. As such, the hatch system 84 provides the user with a convenient means for adjusting the temperature of the tub water without having to leave the tub. By opening the hatch system 84, the user will divert water from the upper portion of the hot tub, where the temperature is relatively high, directly to the pool. This action will result in cooling the hot tub water.

Figure 2:
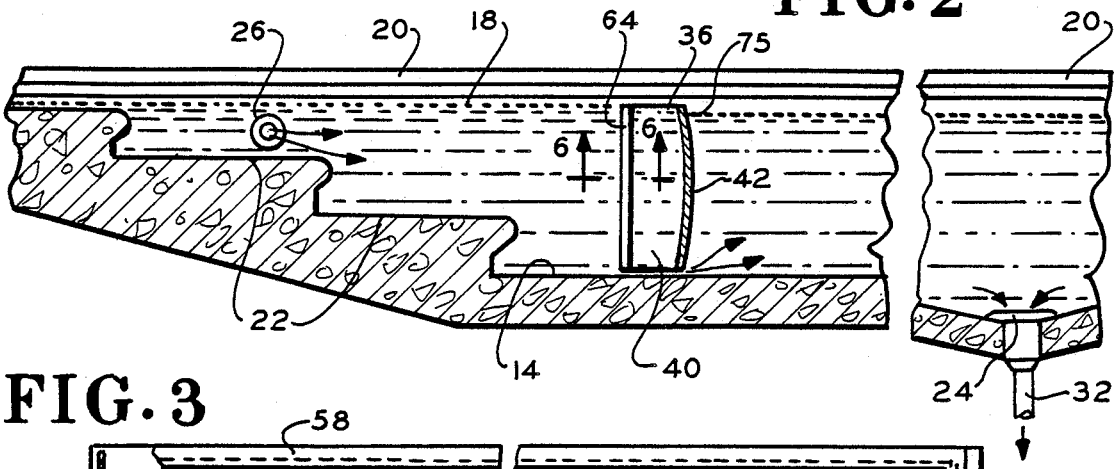
FIG. 2 shows a side elevations, partly in section, of a portion of the structure shown in FIG. 1.
Figure 8:
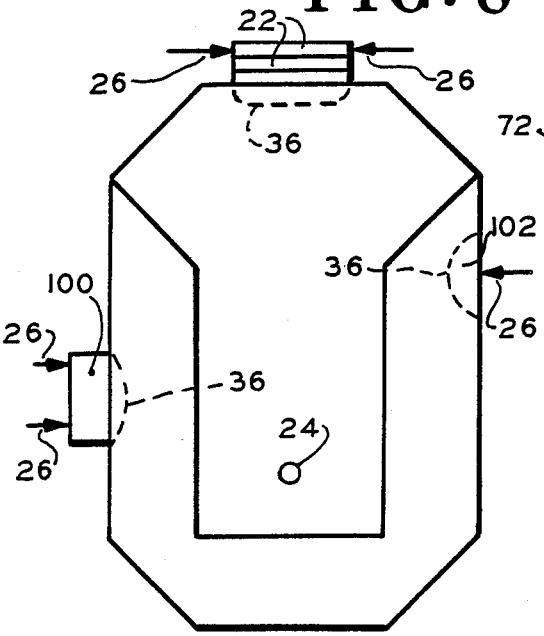
FIG. 8 is a diagrammatic top view illustrating various embodiments of the invention.

The barrier system 36 is shown in FIGS. 1, 2 to be placed adjacent the conventional entrance stairs to the tank 12. In many situations, this placement is preferred because the steps 22 make it easy for a user to enter and exit the tub, and provide a convenient place for the user to recline. Alternative placements for the barrier system 36 will become evident to those skilled in these arts. For example, with reference to FIG. 8, the barrier system 36, shown in dashed lines, may also be placed adjacent a typical love seat 100, having one or more hot water inlet nozzles 26 (indicated by arrows), or may be simply placed along a vertical side wall, indicated by reference 102. Also shown diagrammatically in FIG. 8, the area of the steps 22 may have a plurality of hot water inlet nozzles 26. These nozzles 26 may be designed to produce water jets capable of creating a whirlpool effect in the hot tub. Additionally, various "spa" devices, e.g. aerotors, agitators, etc., may be added to the hot tub areas.

It is well known to those skilled in these arts that one serious impediment to the use of hot tubs, especially by private pool owners, is the great amount of maintenance required including the addition of measured amounts of chemicals to prevent the growth of bacteria, algae and other matter which results from the high water temperatures. With the present invention, these problems are significantly reduced or eliminated since the user would have a continuous supply of freshly treated water drawn by the system 28 from the entire pool area which, of course, is at a lower temperature. The water in the hot tub would eventually work its way back into the pool area. As such, the water in all parts of the swimming pool system 10 would not be stagnant as in a conventional hot tub. Finally, when the partition 42 is removed, the hot tub water would quickly mix with the pool area water.

It was noted earlier that the heater 31 in the water processing system 28 may be selected from the many commercially available units used to fabricate a heated swimming pool system. Such units, when operating to heat a pool under normal conditions, will generally generate sufficient heat to operate the present hot tub. To enhance the hot tub operation, however, the partition 40 may be readily constructed to have heat insulation properties. In any case, in a typical installation, the conventional processing system 28 will produce sufficient heat and water flow such that the temperature in the hot tub will quickly reach a maximum.

It should be understood, of course, that the foregoing disclosure relates to only preferred embodiments of the invention and that numerous modifications may be made therein by those skilled in these arts. For example, in some cases, it may be desirable to have means for causing the partition 40 to break away from the fasteners 64, 72 if a user should fall into the partition 42. In the preferred configuration, this feature may be provided by selecting an appropriate width for the slots 66, 76 such that the ribs 52, 54 will easily pass therethrough when they are compressed and pulled from the slots 66, 76 as a result of the reaction forces caused by the weight of the user falling on partition 40. Still further, in some installations, it may be desirable to have a barrier system 36 that can be mounted in the tank without requiring a fastening apparatus that alters the structure of the tank walls. In such cases, means may be readily provided wherein the partition is removably attachable to the adjacent deck 20. Since many other modifications and variations of the present invention are possible in the light of the above teachings, it is to be understood, that within the scope of the appended claims, the invention may be practiced otherwise than as specifically described.

What is claimed is:

1. A swimming pool-hot tub combination comprising:

a water tank;

a water inlet connected to said tank at a first location;

means connected to said inlet and said outlet for removing water from said second location via said outlet, for heating the water, and for supplying the heated water at a first rate to said first location via said inlet; and a barrier having means removably mounting said barrier in said tank for selectively dividing said tank into a pool area including said second location and a hot tub area including said first location to permit one-way free flow of water from said hot tub area directly into said pool area while preventing the flow of water from said pool area directly back into said hot tub area so that a continuous flow of hot water from said hot tub area can flow directly into a pool of cooler water in said pool area.

2. The combination of claim 1 wherein said barrier includes a flexible sheet.

3. The combination of claim 2 wherein said means for removably mounting said barrier includes fastening means for removably fastening said sheet to said tank.

4. The combination of claim 3 wherein said fastening means includes a slotted channel joined to said tank and an enlarged rib formed on said sheet whereby said rib is slidably received in said channel for mounting said sheet.

5. The combination of claim 4 further including platform means located in said tub area on which a user may recline.

6. The combination of claim 5 wherein said platform means includes a plurality of steps for entering said tank.

7. The combination of claim 4 wherein said barrier further includes water temperatures control means for permitting selective adjustment of the rate of heat flow from said tub area to said pool area.

8. A swimming pool-hot tub combination comprising:
a water tank;
a water inlet connected to said tank at a first location;
a water outlet connected to said tank at a second location;
means connected to said inlet and said outlet for removing water from said second location via said outlet, for heating the water, and for supplying the heated water at a first rate to said first location via said inlet; and
barrier means including a flexible sheet and fastening means for removably fastening said sheet to said tank for selectively dividing said tank into a pool area including said second location and a hot tub area including said first location, and for permitting water to flow from said tub area directly to said pool area at a rate no greater than said first rate, wherein said fastening means includes a slotted channel joined to said tank and an enlarged rib formed on said sheet whereby said rib is slidably received in said channel for mounting said sheet, and wherein said barrier means further includes water temperature control means comprising an opening formed in said sheet and a flap means for variably and selectively covering said opening for permitting selectiv adjustment of the rate of heat flow from said tub area to said pool area.

9. The combination of claim 8 wherein said flap means includes a first flap hinged to said sheet adjacent said opening in said sheet and having an opening in said flap, and a second flap hinged on said first flap for selectively covering the opening in said flap.

10. A swimming pool-hot tub combination comprising:
a water tank;
a water inlet connected to said tank at a first location;
a water outlet connected to said tank at a second location;
means connected to said inlet and said outlet for removing water from said second location via said outlet, for heating the water, and for supplying the heated water at a first rate to said first location via said inlet; and
barrier means including a flexible sheet and fastening means for removably fastening said sheet to said tank for selectively dividing said tank into a pool area including said second location and a hot tub area including said first location, and for permitting water to flow from said tub area directly to said pool area at a rate no greater than said first rate, wherein said fastening means includes a slotted channel joined to said tank and an enlarged rib formed on said sheet whereby said rib is slidably received in said channel for mounting said sheet, and wherein said barrier means further includes water temperature control means comprising an opening in said sheet and a plurality of superimposed flaps hinged to said sheet and each said flap having openings of different sizes therein whereby said flaps may be used to selectively cover said openings for permitting selective adjustment of the rate of heat flow from said tub area to said pool area.

11. A swimming pool-hot tub combination comprising:
a water tank having a bottom wall, side walls and an open top;
a water inlet connected to said tank at a first location;
a water outlet connected to said tank at a second location;
means connected to said inlet and said outlet for removing water from said second location via said outlet, for heating the water, and for supplying the heated water at a first rate to said first location via said inlet;
barrier means, havng means for removably connecting said barrier means to said side walls, for selectively dividing said tank into a pool area including said second location and a hot tub area including said first location to permit one way free flow of water from said hot tub area directly into said pool area and to prevent the flow of water from said pool area back into said hot tub area so that a continuous flow of hot water from said hot tub area can pass directly into a pool of cooler water in said pool area.

12. The combination of claim 11 wherein said barrier means includes a flexible sheet having means on opposite ends thereof for removably fastening said sheet to opposed ones of side walls.

13. The combination of claim 11 further including first and second slotted channels mounted on opposed side walls of said tank and wherein said barrier means includes a flexible sheet having ribs thereon slidably received in said slotted channels.

14. A swimming pool-hot tub combination comprising:
a water tank having a bottom wall, side walls and an open top;
a water inlet connected to said tank at a first location;
a water outlet connected to said tank at a second location;
means connected to said inlet and said outlet for removing water from said second location via said outlet, for heating the water, and for supplying the heated water at a first rate to said first location via said inlet;
barrier means, having means for removably connecting said barrier means between said side walls, for selectively dividing said tank into a pool area including said second location and a hot tub area including said first location, and for permitting water to flow from said tub area directly to said pool area at a rate no greater than said first rate; and
first and second slotted channels mounted on opposed side walls of said tank and wherein said barrier means includes a flexible sheet having ribs thereon slidably received in said slotted channels, and wherein said barrier means further includes an opening in said sheet and a plurality of superimposed flaps hinged to said sheet and each said flap having openings of different sizes therein whereby said flaps may be used to selectively cover said openings.

15. The combination of claim 1 wherein the rate of water flow from said hot tub area to said pool area is substantially equal to said first rate.

16. The combination of claim 1 wherein the size of said pool area is substantially greater than the size of said hot tub area.

17. The combination of claim 1 wherein a gap is formed between said barrier and said tank through which a free flow of water can occur from said hot tub area to said pool area.

18. The combination of claim 1 wherein at least one opening is formed in said barrier through which a free flow of water can occur from said hot tub area to said pool area.

19. The combination of claim 3 wherein said fastening means fastens at least a first portion of the edges of said sheet to said tank, and a second portion of the edges of said sheet are not fastened so that the second portion defines at least one edge around which a free flow of water can occur from said hot tub area to said pool area.

20. The combination of cliam 19 wherein said second portion includes at least a portion of the bottom edge of said sheet.

* * * * *